US009534438B2

(12) United States Patent
Loda

(10) Patent No.: US 9,534,438 B2
(45) Date of Patent: Jan. 3, 2017

(54) ROTO-TRANSLATING SYSTEM FOR OPENING AND CLOSING A WING AND WING ASSEMBLY COMPRISING SAID SYSTEM

(71) Applicant: Belo & Scotch Ltd., Clonakilty, County Cork (IE)

(72) Inventor: Simon Roger Loda, Moniga del Garda (IT)

(73) Assignee: BELO & SCOTCH LTD., County Cork (IE)

( * ) Notice: Subject to any disclaimer, the term of this patent is extended or adjusted under 35 U.S.C. 154(b) by 0 days.

(21) Appl. No.: 14/896,207

(22) PCT Filed: Jun. 6, 2014

(86) PCT No.: PCT/IB2014/062032
§ 371 (c)(1),
(2) Date: Dec. 4, 2015

(87) PCT Pub. No.: WO2014/195921
PCT Pub. Date: Dec. 11, 2014

(65) Prior Publication Data

US 2016/0130858 A1 May 12, 2016

(30) Foreign Application Priority Data

Jun. 6, 2013 (IT) ..... MI2013A0933

(51) Int. Cl.
*E05D 15/36* (2006.01)
*E06B 3/50* (2006.01)
(Continued)

(52) U.S. Cl.
CPC ..... *E06B 3/5018* (2013.01); *E05D 15/28* (2013.01); *E05D 15/36* (2013.01); *E05D 15/48* (2013.01);
(Continued)

(58) Field of Classification Search
CPC ..... E05D 15/28; E05D 15/36; E05D 15/48; E05D 15/485; E05D 15/30; E06B 3/5018; E06B 3/5009; E05F 3/22
(Continued)

(56) References Cited

U.S. PATENT DOCUMENTS 1,252,448 A * 1/1918 Kees ..... E05D 15/38 49/197
1,808,837 A * 6/1931 Clark ..... E05F 3/16 16/49
(Continued)

FOREIGN PATENT DOCUMENTS

DE 618077 C 8/1935
FR 2914680 A1 10/2008

OTHER PUBLICATIONS

International Search Report PCT/ISA/210 for International Application No. PCT/IB2014/062032, Apr. 8, 2014.
(Continued)

*Primary Examiner* — Katherine Mitchell
*Assistant Examiner* — Abe Massad
(74) *Attorney, Agent, or Firm* — Harness, Dickey & Pierce, PLC

(57) ABSTRACT

A roto-translating system for opening and closing a wing which is configured to be mounted on a frame of the wing is provided with a first guide and a second guide arranged so as to define an angle greater than or equal to 90°; a first carriage and a second carriage which are configured to be coupled to an upper edge of the wing and to engage in a sliding manner the first guide and the second guide respectively; a spacer arm provided with a first end, which is configured to be fixed to a first structural element of the frame in a rotating manner about a first vertical axis, and a second end which is configured to be coupled to a lower edge of the wing.

14 Claims, 8 Drawing Sheets

(51) Int. Cl.
*E05D 15/28* (2006.01)
*E05D 15/48* (2006.01)

(52) U.S. Cl.
CPC ..... *E05D 2015/485* (2013.01); *E05Y 2201/64* (2013.01); *E05Y 2900/112* (2013.01)

(58) Field of Classification Search
USPC ..... 49/246; 16/50, 65
See application file for complete search history.

(56) References Cited

U.S. PATENT DOCUMENTS 2,923,981 A * 2/1960 Beck ..... E05D 15/425 49/205
4,286,411 A * 9/1981 Wikkerink ..... E05D 15/30 49/252
5,090,171 A * 2/1992 Kano ..... E04B 2/827 160/199
5,337,520 A * 8/1994 Uribe ..... E05D 13/003 49/197
8,099,904 B2 * 1/2012 Saccon ..... E05D 15/30 49/246
2009/0217593 A1 * 9/2009 Holst ..... E05D 15/30 49/400
2012/0124773 A1 * 5/2012 Saccon ..... E05D 15/30 16/249

OTHER PUBLICATIONS

Written Opinion of the International Searching Authority PCT/ISA/237 for International Application No. PCT/IB2014/062032, Apr. 8, 2014.

* cited by examiner

ROTO-TRANSLATING SYSTEM FOR OPENING AND CLOSING A WING AND WING ASSEMBLY COMPRISING SAID SYSTEM

CROSS-REFERENCE TO RELATED APPLICATIONS

This application is a national phase under 35 U.S.C. §371 of PCT International Application No. PCT/IB2014/062032 which has an International filing date of Jun. 6, 2014, which claims priority to Italian Application No. MI2013A000933, filed Jun. 6, 2013, the entire contents of each of which are hereby incorporated by reference.

TECHNICAL FIELD

The present invention relates to a roto-translating system for opening and closing a wing and to a wing assembly comprising said system.

BACKGROUND ART

The systems for opening and closing wings are basically divided into three categories: rotary or swing opening and closing systems, wherein the wing is hinged along one side and rotates about an axis of rotation; opening and closing translating systems, wherein the wing is provided with one or more carriages able to slide along a linear guide; and opening and closing roto-translating systems wherein the wing is able to rotate about an axis and simultaneously translate along a predetermined direction.

The opening and closing roto-translating systems are very useful in situations where there is little space available for the wing movement.

In FIGS. 1-4, for example, two opening and closing systems of rotary type are compared (FIG. 1 with outward opening and FIG. 2 with inward opening), a roto-translating opening system of known type (FIG. 3), and an opening and closing roto-translating system according to the present invention (FIG. 4).

The examples refer to an application in a particularly restricted environment, for example toilet facilities in public places such as airports, gas stations, schools, etc. In said environments, the wing operation space must be minimized while ensuring the user to comfortably move into the environment with safety and hygiene.

In FIGS. 1-4 with the letter A are indicated the bathroom fixtures dimensions, with the letter B are indicated the user occupancy dimensions, and with the dotted line is indicated the operation space for opening and closing the wing. The comparison shows clearly that the overall dimensions required by the roto-translating system for opening and closing the wing according to the present invention are significantly lower than those normally used by the swing system and by the roto-translating system of known type.

The roto-translating opening and closing system according to the present invention is obtained so as not to occupy space outside the room during each operation.

Systems for opening and closing of this type are known. However, they require guides arranged along the floor to avoid the wing from being unstable during the roto-translation. The presence of at least one guide along the floor, however, is to be avoided, especially in public places. Within the guide, in fact, in the long run, dirt and bacteria are collected which prove difficult to eliminate.

Moreover, the partition walls between the public toilets are mostly raised above the floor and supported by uprights. In this case the access wings to toilets must obligatorily be raised with respect to the floor and free of guides arranged on the floor.

DISCLOSURE OF INVENTION

It is an object of the present invention to provide a roto-translating system for opening and closing a wing that is devoid of the drawbacks of the prior art highlighted here; in particular, it is an object of the invention to provide a roto-translating system for opening and closing a wing that allows to overcome the drawbacks mentioned above in a simple and economical way, both from the functional and constructive point of view.

In accordance with these purposes, the present invention relates to a roto-translating system for opening and closing a wing according to claim 1.

The present invention also relates to a wing assembly free of the drawbacks of the known art. In accordance with these objects, the present invention relates to a wing assembly according to claim 13.

BRIEF DESCRIPTION OF THE DRAWINGS

Further characteristics and advantages of the present invention will become clear from the following description of a non-limiting embodiment, with reference to the figures of the accompanying drawings, wherein.

BEST MODE FOR CARRYING OUT THE INVENTION

Figure 1:
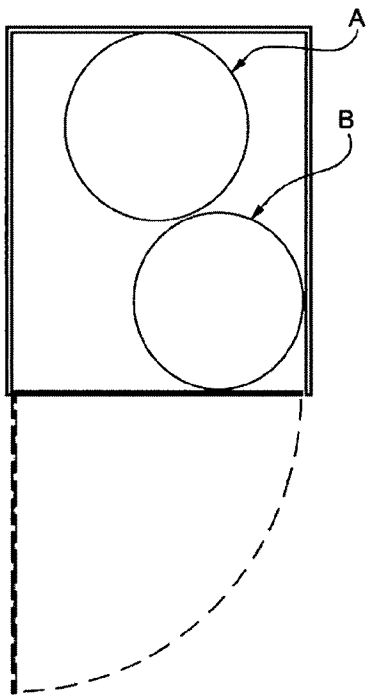
FIG. 1 PRIOR ART
FIGS. 1, 2 and 3 illustrate the operation space of an example of a system for opening and closing a wing according to the prior art.
Figure 2:
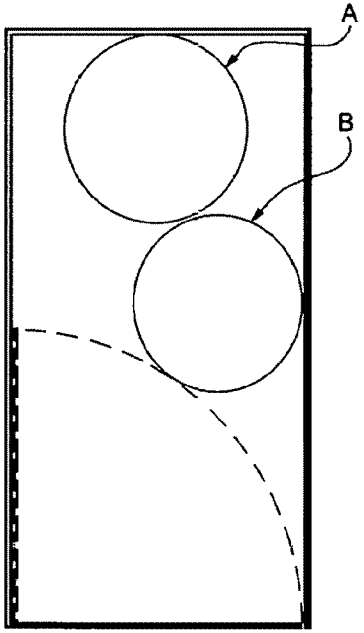
FIG. 2 PRIOR ART
Figure 3:
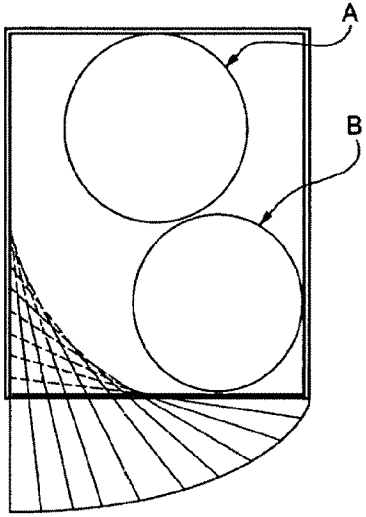
FIG. 3 PRIOR ART
Figure 4:
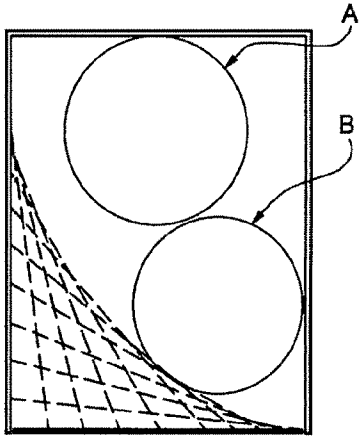
FIG. 4 shows the operation space of a roto-translating system for opening and closing a wing according to the present invention.
Figure 5:
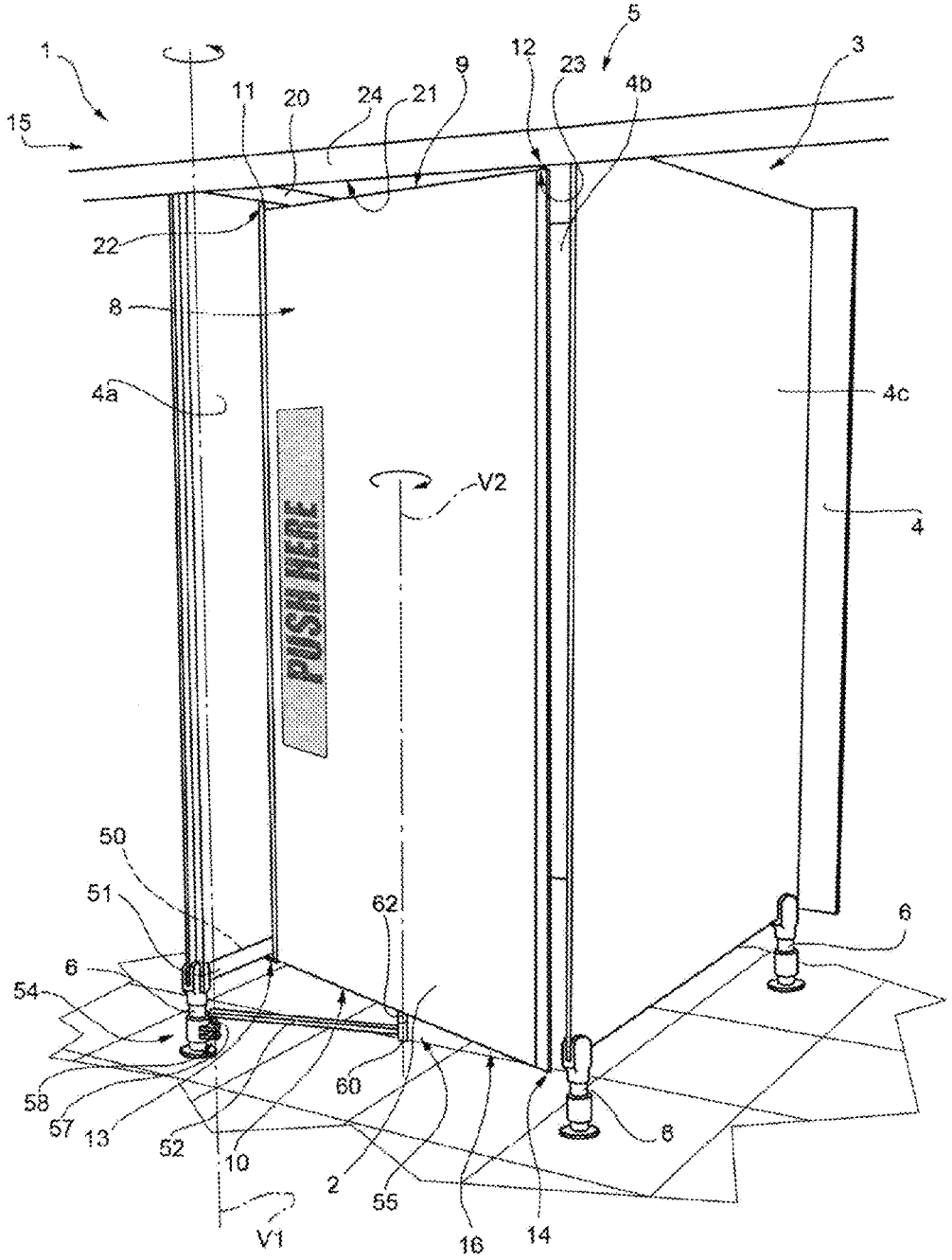
FIG. 5 is a perspective view, with parts removed for clarity, of the roto-translating system for opening and closing a wing according to the present invention in a first operating position.

In FIG. 5 is indicated, with the reference number 1, a roto-translating system for opening and closing a wing 2. In the non-limiting example described and illustrated here, the system 1 is applied to a vertical paneling 3 arranged in an environment so as to define a plurality of rooms 5 adapted to accommodate toilets, offices, etc.

Generally the paneling 3 is defined by a plurality of panels 4 which are configured to be coupled together and made with a laminated material and consisting of several layers of paper impregnated with thermosetting resins and compacted by the combined action of heat and high pressure.

It is understood that the system according to the present invention can be applied to walls or wings made of any material having any thickness.

Figure 6:
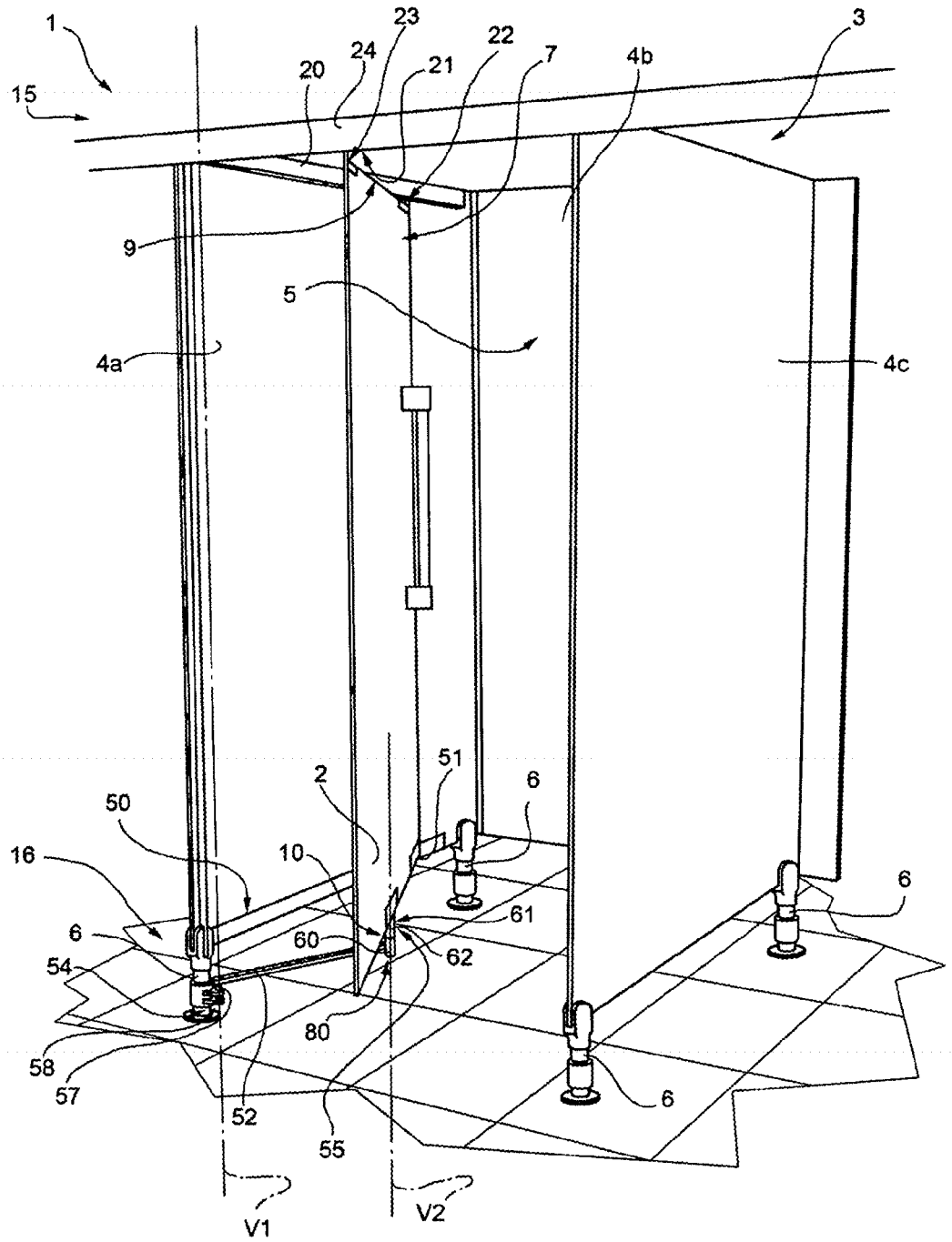
FIG. 6 is a perspective view, with parts removed for clarity, of the roto-translating system for opening and closing a wing according to the present invention in a second operating position.
Figure 7:
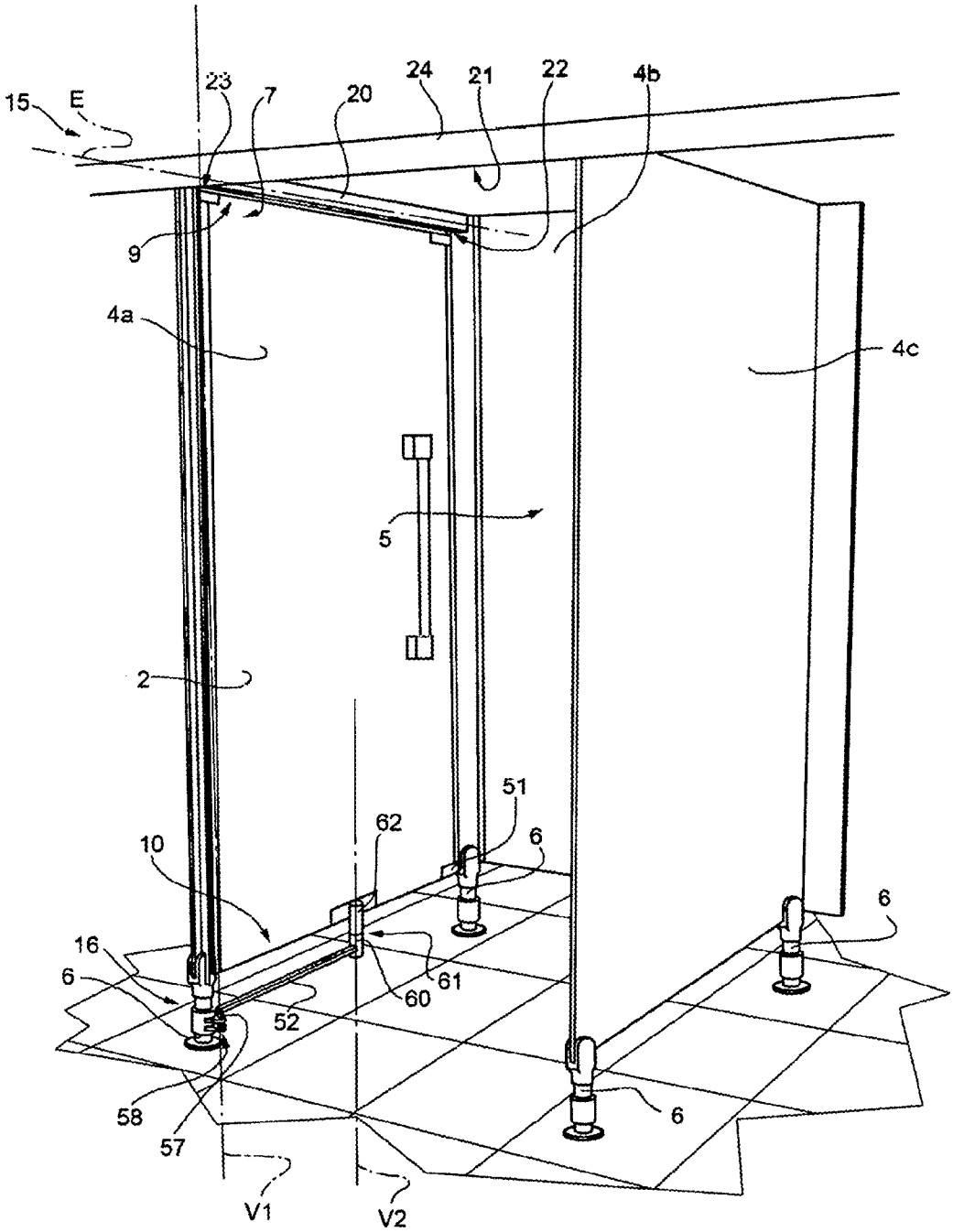
FIG. 7 is a perspective view, with parts removed for clarity, of the roto-translating system for opening and closing a wing according to the present invention in a third operating position.

In FIGS. 5-7 a portion of the panels 3 is shown wherein a side panel 4, a bottom panel 4*b* and a further side panel 4*c*, which define a room 5 are visible.

In most cases, the bottom panel 4*b* is not present and the side panels 4*a* and 4*c* are fixed directly to a wall of the building.

Each panel 4 is supported by at least one foot 6 so as to avoid the panel 4 to be arranged in contact with the floor. This solution is preferable to avoid the presence of hard to clean corners. It is understood that the system according to the present invention can be applied to walls also in direct contact with the floor.

In the non-limiting example here described and illustrated each panel 4*a*, 4*b*, 4*c* is supported by two feet 6 and the wing 2 is a door.

The wing 2 has an inner face 7 (FIG. 6), which faces in use the room 5, an outer face 8 (FIG. 5), which faces in use outside the room 5, an upper edge 9 and a lower edge 10. The upper edge 9 is provided with two upper corners 11, 12, while the lower edge 10 is provided with two lower corners 13, 14.

The system 1 comprises an upper guide assembly 15, adapted to upwardly guide the roto-translation movement of the wing 2, and a lower guide assembly 16, adapted to downwardly guide the roto-translation movement of the wing 2.

The upper guide assembly 15 comprises a first guide 20, a second guide 21, a first carriage 22 and a second carriage 23.

The first guide 20 and the second guide 21 are arranged so as to define an angle comprised between about 90° and about 179° degrees.

In the non-limiting example here described and illustrated, the first guide 20 and the second guide 21 are arranged substantially orthogonal and define an angle of 90°.

The first carriage 22 and the second carriage 23 are configured so as to slide respectively along the first guide 20 and the second guide 21.

In detail, the first guide 20 is supported by one among the first side wall 4*a* and the second side wall 4*c* (in the example of FIGS. 5-7 the first guide 20 is supported by the first side wall 4*a*), while the second guide 21 (not clearly visible in FIGS. 5-7) is supported by the paneling 3 so as to be arranged substantially perpendicular to the side wall that supports the first guide 20.

Preferably, the second guide 21 is supported by an upright 24, which extends between the first side wall 4*a* and the second side wall 4*c*, in a direction substantially orthogonal to the side wall 4*a* that supports the first guide 20.

A variant not shown envisages that the second guide 21 is self-supporting.

The first carriage 22 and the second carriage 23 are fixed to the upper edge 9 of the wing 2, substantially at the respective upper corners 11 and 12.

Figure 8:
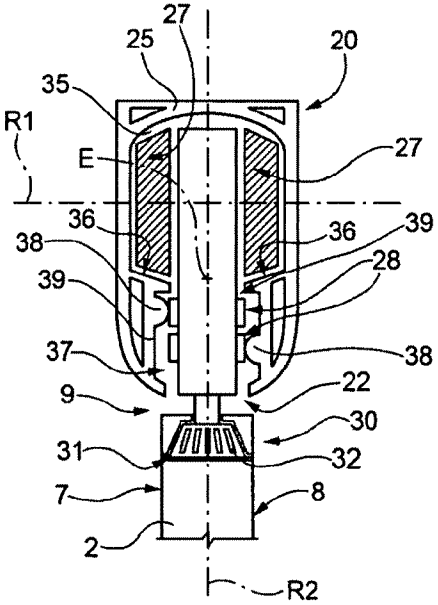
FIG. 8 is a sectional view, with parts removed for clarity, of a first detail of the roto-translating system for opening and closing a wing according to the present invention.

In FIG. 8 a sectional view of the first guide 20 is shown through which the respective first carriage 22 slides.

The first guide 20 comprises a structural section 25, which extends along a longitudinal axis E and is shaped to accommodate the respective first carriage 22 in a sliding manner.

In particular, the first carriage 22 comprises a first pair of wheels 27 for the sliding of the first carriage 22 in the first guide 20 along the axis E and a second pair of wheels 28 adapted to prevent swaying of the wing 2 in the direction transverse to the axis E during the sliding of the first pair of wheels 27.

The first pair of wheels 27 rotates about a first axis R1 orthogonal to the axis E, while the second pair of wheels 28 rotates about a second axis R2 orthogonal to the axis E and to the first axis R1.

The first carriage 22 is also provided with an end 30 shaped so as to engage a respective seat 31 obtained in the wing 2 along the upper edge 9.

The seat 31 preferably has a dovetail shaped section adapted to prevent the end 30 from moving along the axis R2 and ensure the engagement of the wing 2 to the first guide 20.

The end 30 is shaped so as to engage in a rotating manner the seat 31 of the wing 2.

In particular, the end 31 rotates about the axis of rotation R2.

In particular, the end 30 is substantially frustoconical and is provided, along its outer surface, with inserts 32 adapted to facilitate the rotation of the end 30 inside the seat 31.

The first guide 20 comprises a first longitudinal seat 35, which extends along the axis E and comprises two axial sliding faces 36 whereon the wheels 27 slide.

The first guide 20 also comprises a second longitudinal seat 37, which comprises two ribs 38, extending along two respective opposite axial faces 39 and are adapted to define an abutment for the wheels 28.

The second guide 21 and the second carriage 23 are configured to be coupled substantially in a similar way to the first guide 20 and to the first carriage 22.

Figure 9:
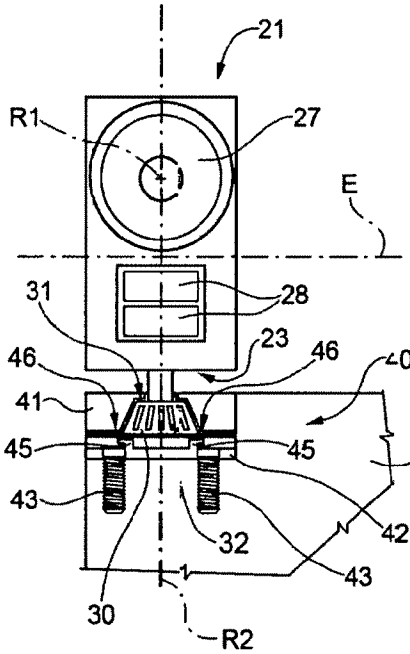
FIG. 9 is a sectional view, with parts removed for clarity, of a second detail of the roto-translating system for opening and closing a wing according to the present invention.

With reference to FIG. 9, the second guide 21 and the second carriage 23 are different from the first guide 20 and from the first carriage 22 for the presence of a quick unblocking system 40 configured to allow the unblocking of the second carriage 23 from the wing 2.

The wing 2 is, in fact, provided with a portion 41 selectively removable. The portion 41 comprises the seat 31 and is configured to be coupled to the main body of the wing 2 by means of a coupling element 42.

The coupling element 42 is fixed to the main body of the wing 2 by means of two screws 43 and is provided with two teeth 45, which are adapted to engage two respective seats 46 of the portion 41.

The teeth 45 and the seats 46 are shaped so as to prevent, when coupled, the movement along the axis R2 and allow the sliding movement of the teeth 45 inside the seats 46 along the axis R1. In this way, it is possible to obtain the unblocking of the portion 41 from the wing 2 by a simple sliding of the portion 41 along the axis R1 to allow the teeth 45 to exit from the respective seats 46.

Figure 10:
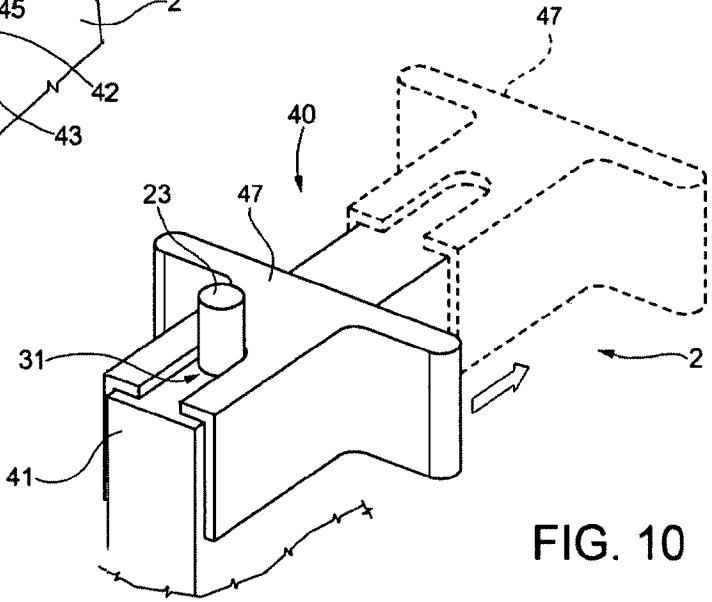
FIG. 10 is a perspective view, with parts removed for clarity, of a third detail of the roto-translating system for opening and closing a wing according to the present invention.

Preferably, the portion 41 is covered by a mask 47, shown in FIG. 10.

The mask 47 is configured to slide between a blocking position, wherein it covers the portion 41 and prevents the sliding of the portion 41, and an unblocking position (dashed line in FIG. 10), wherein the portion 41 is free to slide along the axis R1 and the unblocking of the portion 41 from the wing 2 is allowed.

Preferably, the mask 47 is provided with a spring system (not visible in the attached figures) configured to return the mask 47 in the blocking position when not stressed.

The unblocking system 40 is particularly useful in that, once the portion 41 is unblocked from the wing 2, the wing 2 can make a rotation towards the outside of the room 5 and ensure, therefore, access to the room 5 also from the outside.

This solution is of crucial importance in cases where the user remains blocked inside the room 5 or in the case where, for example, due to a sudden indisposition, the user obstructs the roto-translation towards the inside of the room 5.

In use, therefore, it is sufficient to perform the displacement of the mask 46 from the blocking position to the unblocking position to unblock the portion 41 of the wing 2.

With reference to FIGS. 5-7, the lower guide assembly 16 comprises a third guide 50, a third carriage 51 and a spacer arm 52.

The third guide 50 is supported by a first side wall 4*a* and the second side wall 4*c* (in the example of FIGS. 5-7 the third guide 50 is supported by the first side wall 4*a*) and is arranged parallel to the first guide 20.

Preferably, the third guide 50 is arranged along the lower edge of the side wall 4*a* in order to be less visible as possible. Preferably, the third guide 50 is recessed in the side wall 4*a*.

The third carriage 51 is coupled to the lower edge 10 of the wing 2 at the lower vertex 13 next to the side wall 4*a* to which the third guide 50 is coupled.

The third carriage 51 is configured to slide along the guide 50.

The guide 50 and the carriage 51 are substantially shaped and coupled in a similar way to the first guide 20 and to the first carriage 22 and therefore will not be described in the following.

It is understood that the third carriage 51 and the guide 50 could have a structure different from that described for the first carriage 22 and for the first guide 20, provided that their structure allows sliding of the carriage 51 along the guide 50.

The spacer arm 52 is provided with a first end 54 configured to be coupled in a rotating manner to a foot 6 which supports the side wall 4*a* to which the third guide 50 and a second end 55 fixed to the lower edge 10 of the wing 2 are coupled.

The first end 54 is rotatable about a first vertical axis V1 and the second end 55 is preferably rotatable about a second vertical axis V2.

The second end 55 is preferably fixed to the wing 2 in a median position of the lower edge 10.

In the case wherein the first guide 20 and the second guide 21 are arranged so as to define an angle comprised between 91° and 179°, the spacer arm 52 is telescopic, so as to follow the movement of the wing 2 during the roto-translation and always remain coupled along the bottom edge 10 and in a median position.

In this way, the spacer arm 52 maintains stable the wing 2 to avoid tilting of the lower edge 10 of the wing 2 during the roto-translation.

Preferably, the spacer arm 52 is a metal bar provided with a pin 57 at the first end 54. The pin 57 is orthogonal to the metal bar and engages in a rotating manner a seat 58 formed in the foot 6.

In correspondence of the second end 55, the metal bar comprises a further pin 60, which engages a respective seat 61 of the wing 2.

In the example illustrated in FIGS. 5-7, the seat 61 is formed in a cylindrical element 62 coupled to the inner wall 7 of the wing 2.

A variant not shown envisages that along the lower edge 10 is formed the seat 61 for housing with freedom of rotation the pin 60.

A variant not shown envisages that the spacer arm 52 is a metal plate so as to minimize the dimension of the spacer arm 52 below the wing 2.

A variant not shown envisages that the first end 54 and the second end 55 of the spacer arm 52 are shaped so as to selectively block the rotation of the first end 54 about the first vertical axis V1 and the rotation of the second end 55 about the second vertical axis V2 so as to block the movement of the wing 2.

Figure 11:
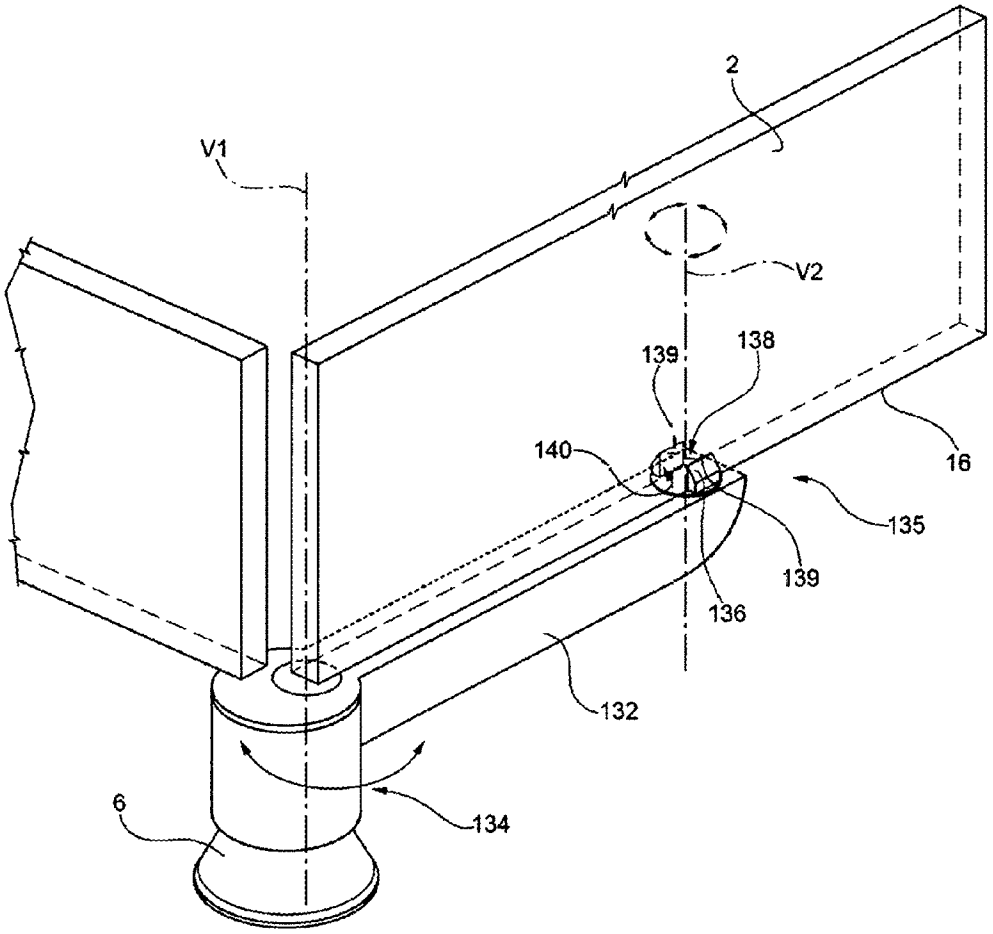
FIG. 11 is a perspective view, with parts removed for clarity, of a fourth the detail of the roto-translating system for opening and closing a wing according to the present invention according to a second embodiment.

In FIG. 11 a spacer arm 132 according to a second embodiment of the present invention is shown. According to this embodiment, the spacer arm 132 has one end 134 coupled to the foot 6 so as to rotate about a first vertical axis V1 and a second end 135, which comprises a coupling element 136, which is configured to be coupled to the spacer arm 132 in a rotating manner with respect to a second vertical axis V2 and shaped so as to define a housing seat 138 for a portion of the lower edge 10 of the wing 2.

Preferably, the coupling element 136 is shaped so that the housing seat 138 is provided with two containment walls 139 parallel and adapted, in use, to be arranged in contact respectively with the inner wall 7 and the outer wall 8 of the wing 2 along the respective contact faces 140.

The more the contact face 140 is extended, the more the grip effect of the coupling element 136 is higher and the more the wing 2 is stable during the roto-translation.

Thanks to the particular configuration of the spacer arm 132, the lower guide assembly 16 of the roto-translating opening and closing system 1 according to the present invention does not require the third guide 50 and the respective third carriage 51.

A variation not shown of the present invention envisages that at the end 135 a pedal which is configured to be coupled to a lever is provided. The pedal is mobile between a first blocking position wherein the lever blocks the rotation of the second end 135 about the respective vertical axis V2 and an unblocking position wherein the lever does not prevent the rotation and the wing 2 is free to roto-translate in accordance with the present invention.

A variant also provides that the pedal is configured so as to further block the rotation of the first end 134 about the first vertical axis V1 in the blocking position.

Figure 12:
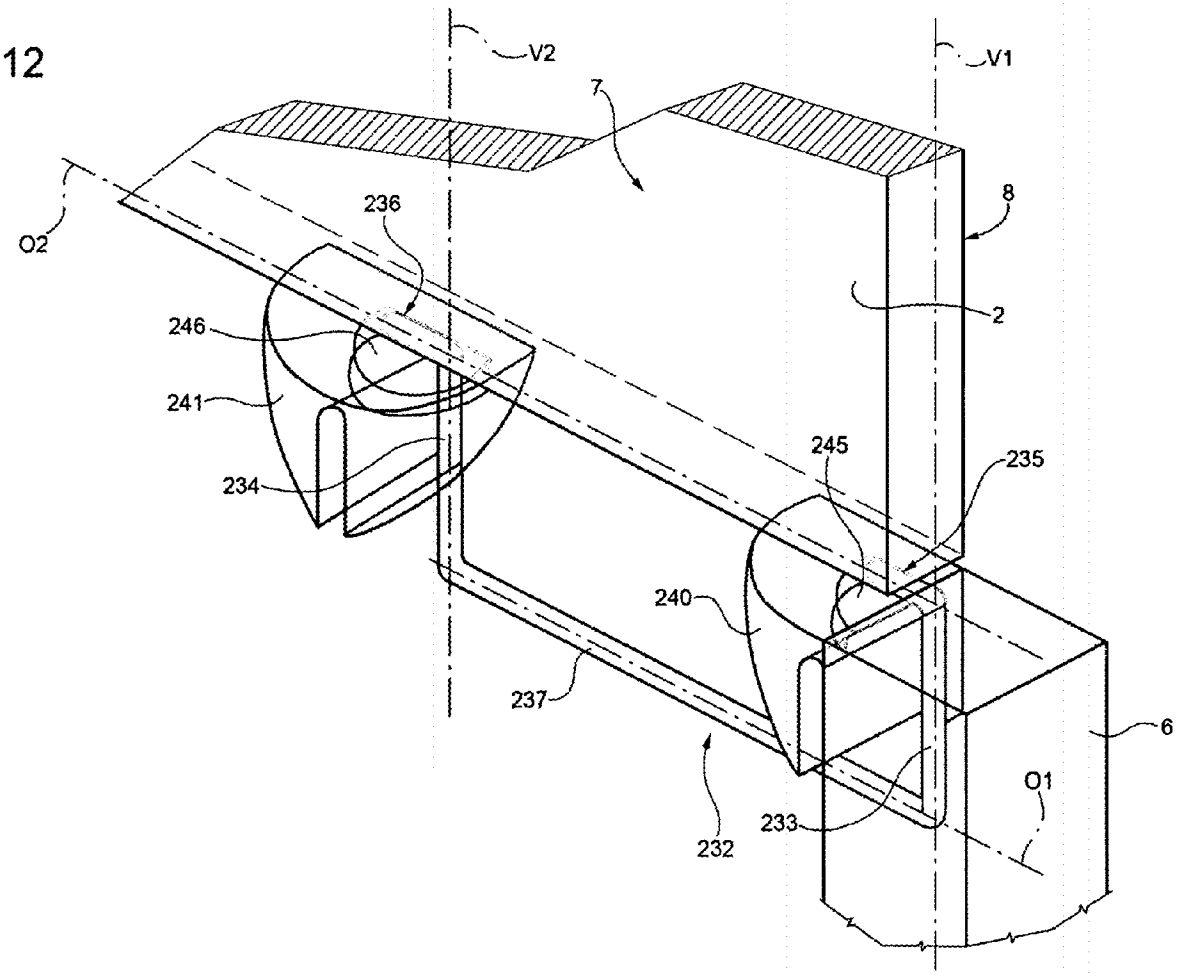
FIG. 12 is a perspective view, with parts removed for clarity, of a fifth detail of the roto-translating system for opening and closing a wing according to the present invention according to a third embodiment in a first operating position.

In FIG. 12 a spacer arm 232 according to a third embodiment is shown wherein the spacer arm 232 has, in addition to the function of stabilizing the wing 2 during the roto-translation, also a further selective blocking function of the opening of the wing 2.

According to said embodiment, the spacer arm 232 is defined by a substantially U-shaped bar, provided with two arms 233 234 having respectively a first end 235 and a second end 236 and joined by a connecting portion 237.

The connecting portion 237 preferably extends along a first horizontal axis O1.

The first end 235 is configured to be coupled to a first coupling element 240 integral with the foot 6 of the wall 4*a*, while the second end 236 is coupled to a second coupling element 241 integral with the wing 2. Preferably, the first coupling element 240 is fixed to the lower corner 13 of the wing 2, while the second coupling element 241 is fixed in a median position of the lower edge 10 of the wing 2.

The first end 235 and the second end 236 are bent at 90° with respect to the extension direction of the arms 233, 234. Preferably, the first end 235 and the second end 236 extend along a second horizontal axis O2.

The first end 235 engages a seat 245 of the first coupling element 240. The seat 245 and the first end 235 are shaped so as to allow the rotation of the first end 235 about the first vertical axis V1 and the second horizontal axis O2.

Figure 13:
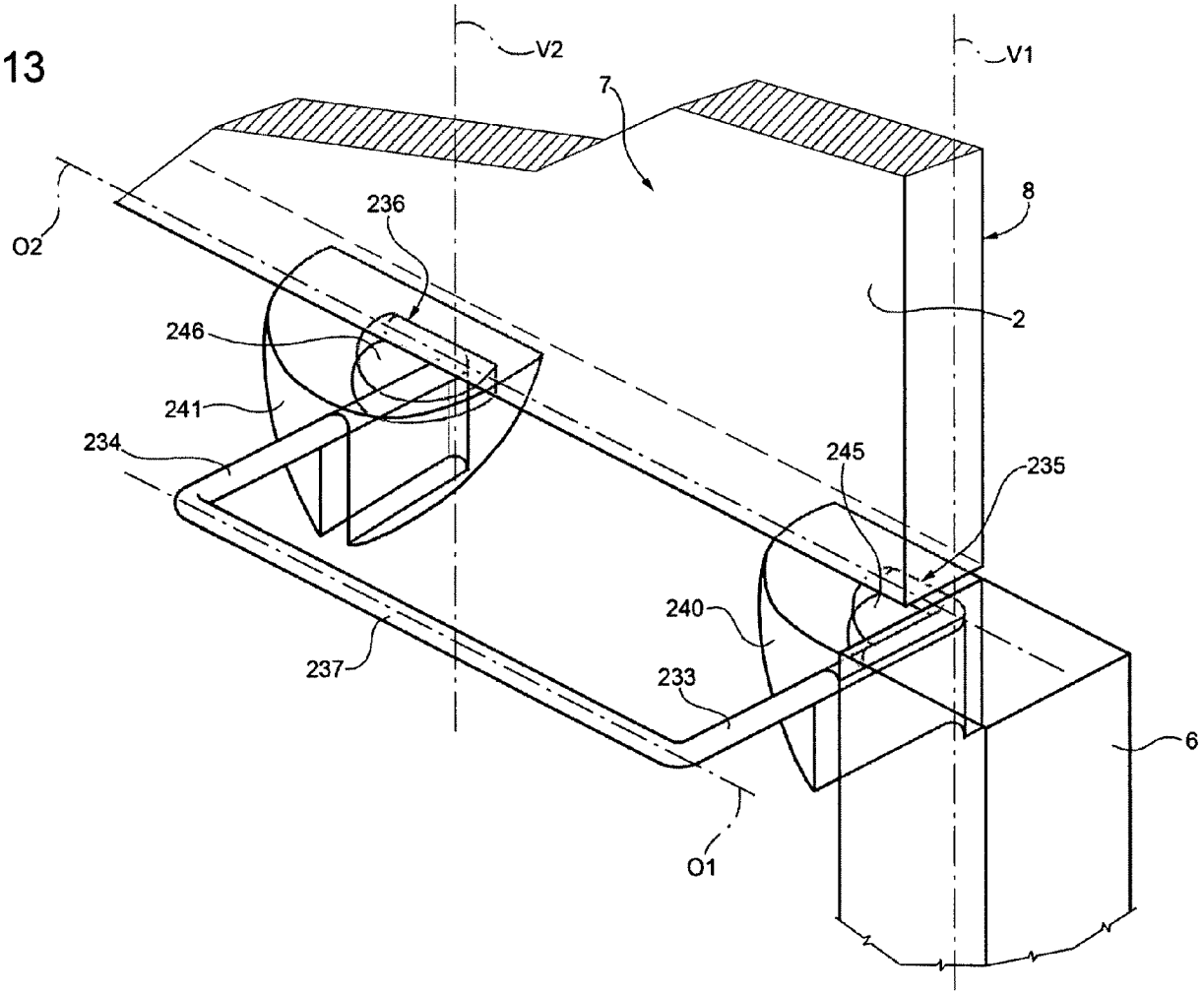
FIG. 13 is a perspective view, with parts removed for clarity, of the fifth detail of the roto-translating system for opening and closing a wing according to the present invention according to a third embodiment in a second operating position.

In particular, the seat 245 has a base shaped substantially as a quarter of a circle so as to allow a rotation of the first end to the maximum of 90° (FIGS. 12, 13).

The second end 236 engages a seat 246 of the second coupling element 241. The seat 246 and the second end 236 are formed so as to allow the rotation of the wing 2 about the second vertical axis V2 with respect to the second end 236 and so to allow the rotation of the second end 236 about the second horizontal axis O2.

In particular, the seat 246 has a base substantially equal to half a circle so as to allow a rotation of the second end 236 to the maximum of 180° (FIGS. 12, 13).

Preferably, the first end 235 and second end 236 are rotatable about the same horizontal axis O2. A variant not shown envisages that the first end 235 is rotatable about a further horizontal axis not coinciding with the second horizontal axis O2.

The spacer arm 232 is therefore rotatable about the first vertical axis V1 and about the second horizontal axis O2 and is connected in a rotating manner to the wing 2 so to allow the rotation of the wing 2 about the second vertical axis V2 with respect to the second end 236 of the spacer arm 232.

In particular, the spacer arm 232 is rotatable about the second horizontal axis O2 between a blocking position (FIG. 13) and an unblocking position (FIG. 12) so as to selectively prevent the opening of the wing 2.

In particular, the spacer arm 232 is rotatable about the second horizontal axis O2 between a blocking position (FIG. 13), wherein the arms 233 and 234 are arranged substantially horizontal and the rotation of the spacer arm 232 about the first vertical axis V1 is prevented by the particular shape of the spacer arm 232 and by the coupling elements 240 and 241 (and therefore the opening of the wing 2 is prevented), and an unblocking position, wherein the arms 233 and 234 are arranged substantially vertical and the rotation of the spacer arm 232 about the first vertical axis V1 is allowed and the opening and closing of the wing 2 is free.

When the door is closed it is sufficient to rotate the spacer arm 232 about the second horizontal axis O2 to move the spacer arm 232 in the blocking position and obtain the blocking of the opening of the wing 2. Advantageously, the displacement of the spacer arm 232 in the blocking and unblocking position can be done easily by means of a foot.

A variation not shown of the present invention envisages that the upper guide assembly comprises a first spacer arm and that the lower guide assembly comprises a second spacer arm. Both spacer arms are hinged to the support wall of the wing so as to be rotatable about a first vertical axis. The second ends of the spacer arms will be coupled respectively to the upper edge and to the lower edge of the wing so as to allow the wing to rotate about a second vertical axis.

Advantageously, the roto-translating system for opening and closing a wing according to the present invention is capable of ensuring a stable roto-translation while avoiding the presence of guides along the floor.

Thanks to the solution, object of the present invention, it is possible to obtain a roto-translating system for opening and closing a wing also fixable to a paneling supported by feet and not coupled directly to the floor.

Furthermore, the roto-translating system for opening and closing a wing according to the present invention does not require operation space outside the room because the opening of the wing takes place completely inside the room.

Thanks to the solution, object of the present invention, also a sitting person can actuate the opening and closing of the wing. This aspect makes the opening and closing system, according to the present invention, compatible also with rooms accessible by disabled persons.

Moreover, the system according to the present invention allows to selectively block the opening of the wing by means of a simple blocking mechanism of the opening (lock) integrated in the system.

Advantageously, the blocking mechanism is achieved thanks to a particular conformation of the spacer arm 232 and of the coupling elements 240 and 241.

Finally, the system according to the present invention is adapted to determine the roto-translating opening and closing of a wing even when the upper guides for the sliding of the first and second carriages are not mutually orthogonal. The system according to the present invention can, in fact, determine the opening and closing of the wing if the guides are arranged to form an angle comprised between 90° and 179°.

Finally, it is evident that the system and the wing assembly described herein may be subject to modifications and variations without departing from the scope of the appended claims.

The invention claimed is:

1. A roto-translating system configured to open and close a wing, the roto-translating system configured to be mounted on a frame of the wing; the roto-translating system comprising:

a first guide and a second guide configured to define a moving region in which the wing moves, the first guide and the second guide defining an angle in the moving region, the angle being defined by intersecting longitudinal axes of the first guide and the second guide, the angle being greater than or equal to 90';

a first carriage and a second carriage which are configured to be coupled to an upper edge of the wing, the first carriage and second carriage configured to slidingly engage with the first guide and the second guide, respectively, such that the wing is suspended vertically from the first guide and the second guide, the first carriage is configured to slide relative to the first guide while in sliding engagement with the first guide, and the second carriage is configured to slide relative to the second guide while in sliding engagement with the second guide; and a spacer arm including a first end and a second end, the first end configured to be fixed to a first structural element of the frame in a rotating manner about a first vertical axis, and the second end configured to be coupled to a lower edge of the wing.

2. The roto-translating system according to claim 1, further comprising:

a third guide which is arranged substantially parallel to the first guide, the third guide is configured to be fixed to a second structural element of the frame, the third guide engaged in a sliding manner by a third carriage, the third carriage configured to be coupled to the lower edge (10) of the wing (2).

3. The roto-translating system according to claim 1, wherein the second end of the spacer arm is configured to be coupled to the wing so that the wing is rotatable about a second vertical axis with respect to the second end.

4. The roto-translating system according to claim 3, wherein the second end of the spacer arm is configured to engage with a seat of the wing such that, the second end of the spacer arm and the seat of the wing define a second vertical axis, the second vertical axis extending through the second end of the spacer arm and the seat of the wing, and the spacer arm is configured to rotate relative to the second end of the spacer arm while the second end of the spacer arm is engaged with the seat of the wing, such that the spacer arm rotates at least partially around the second vertical axis.

5. The roto-translating system according to claim 3, wherein the second end of the spacer arm is provided with a coupling element rotatable with respect to the spacer arm about the second vertical axis and shaped so as to define a housing for the lower edge of the wing.

6. The roto-translating system according to claim 1, wherein the first guide and the second guide are orthogonal.

7. The roto-translating system according to claim 3, further comprising:

a blocking device configured to selectively block the rotation of the wing about the second vertical axis with respect to the second end.

8. The roto-translating system according to claim 7, wherein the blocking device is configured to selectively block the rotation of the first end about the first vertical axis.

9. The roto-translating system according to claim 1, wherein the spacer arm is mobile between an unblocking position, wherein the rotation of the first end about the first vertical axis is free, and a blocking position, wherein the rotation of the first end about the first vertical axis is blocked.

10. The roto-translating system according to claim 9, wherein the spacer arm is configured to rotate about a horizontal axis between the blocking position and the unblocking position.

11. The roto-translating system according to claim 9, wherein the first end and the second end of the spacer arm are rotatable about the horizontal axis.

12. A wing assembly, comprising:

a wing including an upper edge and a lower edge;

a frame of the wing including at least one first structural element; and a roto-translating system configured to open and close the wing, the roto-translating system configured to be mounted on the frame of the wing, the roto-translating system including, a first guide and a second guide configured to define a moving region in which the wing moves, the first guide and the second guide defining an angle in the moving region, the angle being defined by intersecting longitudinal axes of the first guide and the second guide, the angle being greater than or equal to 90°, a first carriage and a second carriage which are configured to be coupled to the upper edge of the wing, the first carriage and second carriage configured to slidingly engage with the first guide and the second guide, respectively, such that, the wing is suspended vertically from the first guide and the second guide, the first carriage is configured to slide relative to the first guide while in sliding engagement with the first guide, and the second carriage is configured to slide relative to the second guide while in sliding engagement with the second guide, and a spacer arm including a first end and a second end, the first end configured to be fixed to the at least one first structural element of the frame in a rotating manner about a first vertical axis, and the second end configured to be coupled to the lower edge of the wing.

13. A roto-translating system configured to open and close a wing, the roto-translating system configured to be mounted on a frame of the wing, the roto-translating system comprising:

a first guide and a second guide configured to define a moving region in which the wing moves, the first guide and the second guide defining an angle in the moving region, the angle being defined by intersecting longitudinal axes of the first guide and the second guide, the angle being greater than or equal to 90°;

a first carriage and a second carriage which are configured to be coupled to an upper edge of the wing, the first carriage and second carriage configured to slidingly engage with the first guide and the second guide, respectively, such that the wing is suspended vertically from the first guide and the second guide, the first carriage is configured to slide relative to the first guide while in sliding engagement with the first guide, and the second carriage is configured to slide relative to the second guide while in sliding engagement with the second guide;

a spacer arm including a first end and a second end, the first end configured to be fixed to a first structural element of the frame so as to be rotatable about a first vertical axis, and the second end configured to be coupled to a lower edge of the wing; and an unblocking system configured to selectively block and unblock the second carriage in relation to the wing.

14. The system of claim 13, wherein the system is configured to be applied to a vertical paneling.

* * * * *